United States Patent [19]

Merriam

[11] 4,108,191

[45] Aug. 22, 1978

[54] FAN MESH DISRUPTER

[75] Inventor: Arthur T. Merriam, Wellesley Hills, Mass.

[73] Assignee: The United States of America as represented by the Secretary of the Army, Washington, D.C.

[21] Appl. No.: 614,389

[22] Filed: Sep. 17, 1975

[51] Int. Cl.[2] ..... A45F 1/04

[52] U.S. Cl. ..... 135/2; 135/25 R; 343/18 B; 343/18 E

[58] Field of Search ..... 89/36 R, 36 A; 114/14, 114/15; 343/18 A, 18 B, 18 E; 135/1 R, 1 A, 1 D, 2, 25 R, 25 A, 3 A, 3 C, 4 A, 4 B, 5 R, 5 A, 5 AT; 428/919

[56] References Cited

U.S. PATENT DOCUMENTS

| | | | |
|---|---|---|---|
| 196,723 | 10/1877 | Sundquist | 135/2 |
| 299,769 | 6/1884 | Ferrell | 135/2 |
| 2,864,389 | 12/1958 | Smith et al. | 135/2 |
| 2,953,145 | 9/1960 | Moss et al. | 135/1 R |

FOREIGN PATENT DOCUMENTS

| | | | |
|---|---|---|---|
| 285,484 | 4/1929 | United Kingdom | 135/2 |

*Primary Examiner*—Stephen C. Bentley

*Attorney, Agent, or Firm*—Nathan Edelberg; Robert P. Gibson; Charles R. Carter

[57] ABSTRACT

An expandable-retractable fan mesh disrupter for camouflaging the shape of the item it is attached to. The disrupter is fabricated of materials and attachments to facilitate rapid emplacement and displacement. In their emplaced expanded condition they confuse potential air and ground observers as to the identity of the objects.

1 Claim, 4 Drawing Figures

FAN MESH DISRUPTER

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

This invention relates to the field of camouflage. The present day techniques of camouflage uses the standard netting procedure. In this procedure excessive time is required to deploy and retract the camouflage material and acts as a determent of the camouflage effectiveness.

SUMMARY OF THE INVENTION

The present invention has provided a solution to the above stated problem by utilizing a fan mesh disrupter that is expandable to an open position and retracted to a closed position. This feature along with the ease of mounting and dismounting the disrupter has greatly reduced the deployment time and hence increase the camouflage effectiveness.

This invention may be better understood from the following detailed description taken in conjunction with the accompanying drawing.

DESCRIPTION OF THE PREFERRED EMBODIMENT

Figure 1:
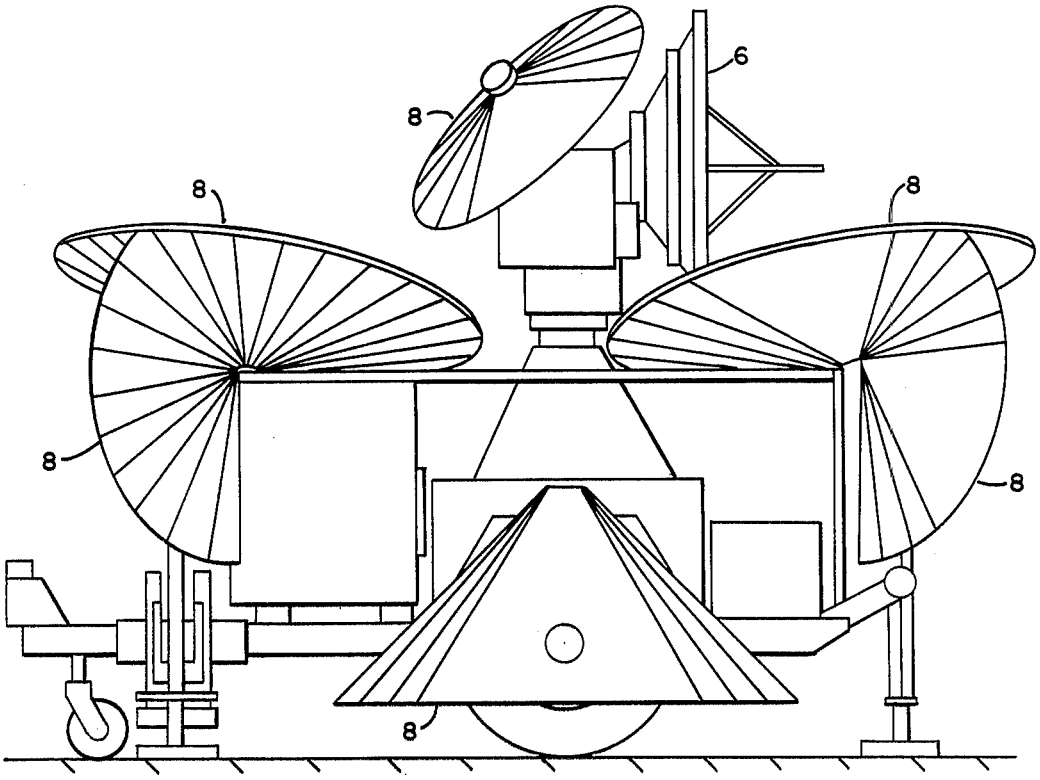
FIG. 1 shows the deployment of several disrupters on a missile system radar.

As seen in FIG. 1 several fan mesh disrupters 8 are mounted on a missile system radar set 6.

Figure 3:
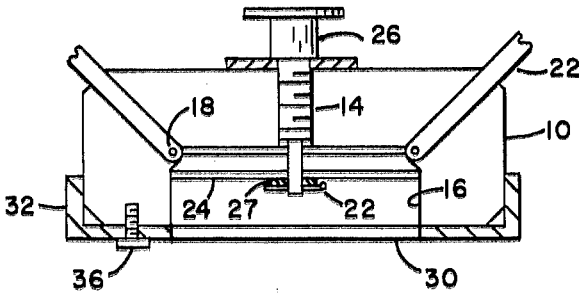
FIG. 3 is a sectional view of the disrupter assembly.
Figure 2:
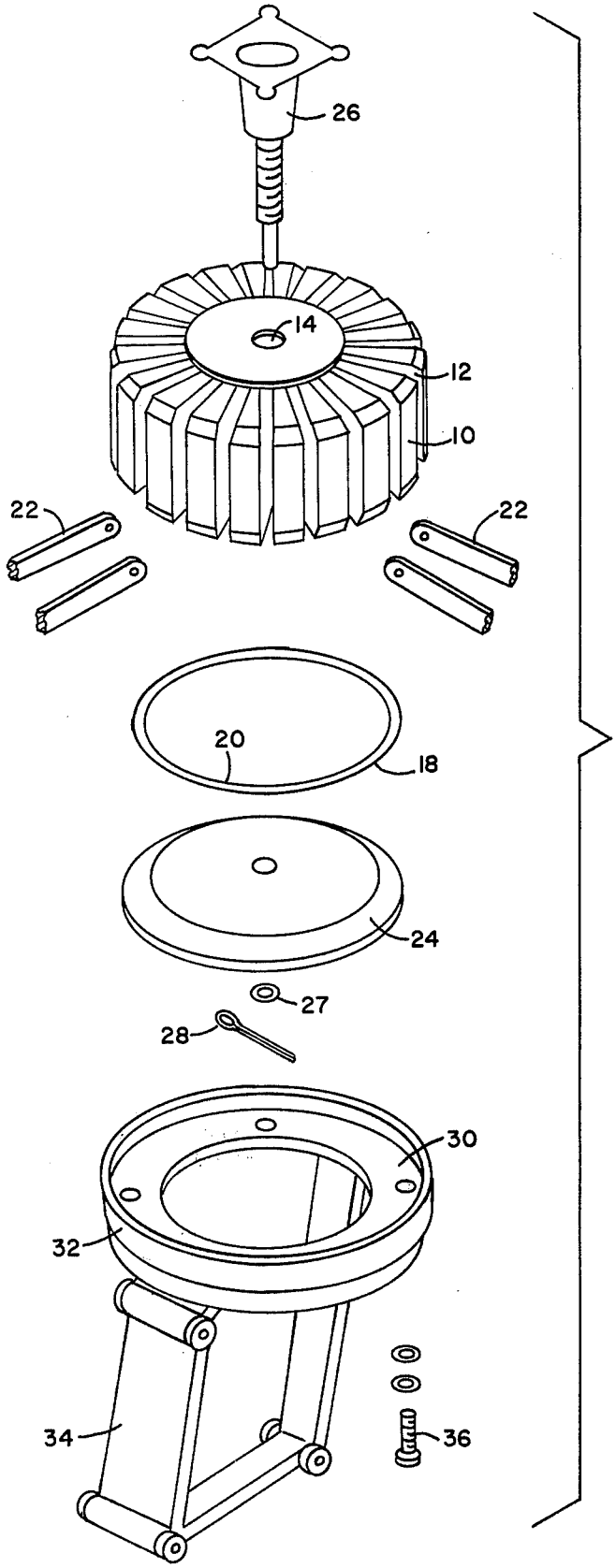
FIG. 2 is an exploded view of the disrupter assembly.

Referring now to FIGS. 2 and 3 reference numeral 10 indicates an aluminum hub provided with a plurality of radial slots 12 equally spaced about the periphery of the hub. The hub is provided with a threaded top opening 14 while the hub bottom is provided with a counterbore recess 16. A ring 18 of corrosion-resistant steel is split at 20 to allow insertion of support ribs 22. The ring 18 is disposed in the recess 16 and ribs 22 are placed in slots 12. A locking plate 24 is placed in engagement with the ring and rib ends to act as a supporting surface therefor. Lock screw 26 is screwed through the top of the hub and the locking plate 24 is secured to the end of the screw by a washer 27 and cotter pin 28. A spacer cup 30 is fitted over the bottom of the hub and the depth of the spacer or flange 32 of the cup is determined by the type of the disrupter on which it is used. There are several basic configurations of disrupters used to camouglage a missile system. The spacer cup and hub are secured to a base assembly 34 by screws 36.

Figure 4:
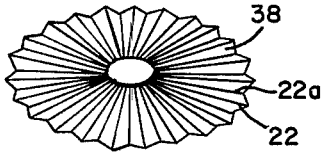
FIG. 4 is a perspective view of the disrupter with the camouflage fabric attached.

As shown in FIG. 4 the support ribs 22 have auxiliary ribs **22*a* pivotally attached thereto and the camouflage mesh netting 38** is secured to all ribs. This disrupter netting is a woven dacron mesh with a ¼ inch square hole size and is fashioned into a diameter fan shape having convolutions. The number of convolutions depends upon whether it is to form a 180°, 270° or 360° final configuration.

In placing the disrupters on the equipment to be camouflaged, the base assembly 34 is interlocked with a corresponding bracket on the equipment and secured. The fan mesh disrupter is then expanded to disrupt the surrounding scenery for camouflage purposes.

I claim:

1. An expandable-retractable fan mesh disrupter for use in camouflaging equipment attached thereto, said disrupter comprising: a hub provided with a threaded top opening, said hub having a plurality of radial slots equally spaced about its outer periphery, the bottom of said hub being provided with a counter-bored recess; a split ring disposed in said recess; a plurality of mesh supporting ribs attached to said split ring, said ribs being disposed in said slots; camouflage mesh connected to said ribs; a locking plate located in said recess to engage and support the ends of said ribs; means for securing said locking plate to said hub whereby said ribs may be moved thereon to expand or retract camouflage mesh disrupter, said securing means including a lock screw for engaging said threaded top opening and a cotter pin at the lower end of said lock screw for engaging said locking plate, and a spacer cup connected to said hub and a flange extending upward from said cup and surrounding said hub to limit movement of said ribs in said radial slots.

* * * * *